US005738083A

United States Patent [19]

Pettinari

[11] Patent Number: 5,738,083

[45] Date of Patent: Apr. 14, 1998

[54] FLOW DEFLECTOR FOR FILTRATION HOOD

[75] Inventor: Pierluigi Pettinari, Cerreto d'Esi, Italy

[73] Assignee: Turboaire S.p.a., Fabriano, Italy

[21] Appl. No.: 585,193

[22] Filed: Jan. 11, 1996

[51] Int. Cl.[6] ..... F24C 15/20

[52] U.S. Cl. ..... 126/299 D; 126/299 R; 454/67

[58] Field of Search ..... 454/49, 67; 126/299 R, 126/299 D

[56] References Cited

U.S. PATENT DOCUMENTS 3,075,335 1/1963 Bandlow ..... 126/299 D X
3,145,643 8/1964 Strouth ..... 126/299 D
4,682,580 7/1987 Fukumoto ..... 126/299 D

FOREIGN PATENT DOCUMENTS 0 050 277 4/1982 European Pat. Off. ..... 126/299 D

*Primary Examiner*—Harold Joyce
*Attorney, Agent, or Firm*—Levine & Mandelbaum

[57] ABSTRACT

The invention relates to a hood for the suction and/or the filtration of cooking smokes in a domestic kitchen, having means which allows one, in a simple and rapid way, to direct the air flow sucked from a cooking stove towards a preferred outlet, among a plurality of possible outlets being provided by the hood, and to simultaneously change the operation of the hood from a filtration mode to a suction mode.

17 Claims, 12 Drawing Sheets

FLOW DEFLECTOR FOR FILTRATION HOOD

FIELD OF THE INVENTION

The present invention relates to a hood for the suction and/or the filtration of the cooking fumes in a domestic kitchen.

DESCRIPTION OF THE BACKGROUND ART

Various types of hoods for domestic use are known, which are used for eliminating cooking smells in a kitchen. Such hoods are called suction hoods if they expel, outside the kitchen, the air drawn from above the stove, or filtration hoods if they recycle the air in the room, after having purified it.

In the aspiration mode, in most cases, the air is expelled from the hood in an upward direction, through a conduit contained and hidden by an overhanging wall cabinet, which expels the air towards the ceiling of the kitchen. Said conduit usually has its axis in the middle vertical plane of the hood, for aesthetic reasons if it is in view, and for reasons of standardization if it is mounted within the wall cabinet.

If the hood is fixed to a wall which is directed outside the building, the air can be expelled towards the rear part of the hood. This embodiment, which is aesthetically pleasant due to the absence of a conduit in view, is however rarely used, because it requires the hole on the wall to be previously made in a very precise position.

On the contrary, in the filtration mode, the air is usually expelled from the hood by means of louvers present in its front part. This is the simplest and cheapest embodiment, because no additional tubes are necessary and the wall cabinet arranged above the hood is free for other purposes, because it is not crossed by the conduit which conveys the air towards the outside. However, due to the fact that the air expelled, this way can be very noisy (because air exits the hood at the users' head height). Often it is preferred to expel the air towards the ceiling, by means of a conduit being hidden in an overhanging wall cabinet which ends on top of the wall cabinet itself.

Summarizing, therefore, known hoods may provide for four operating modes: a filtration mode towards the front part (FA), a filtration mode towards the upper part (FA), a suction mode towards the rear part (AP), and a suction mode towards the upper part (AS).

In order to reduce the number of variations, known hoods are usually conceived so as to provide all the above mentioned four operating modes, which can be set in part by the installer and in part by the final user of the hood. Several users, in fact, prefer to filter and recycle the air during winter, for energy saving reasons, while they prefer to expel the fumes for the remaining part of the year.

The treatment and path of the air which crosses the hood in the upward direction is substantially identical for all the products available on the market: firstly, the air passes through a mechanical filter, called a grease filter, which also serves as a panel for closing the lower part of the hood and can be removed and cleaned by the user. The filter, which is always present, retains solid floating soil conveyed by the cooking fumes, so as to protect the hood from dirt. There are no problems in realizing a sufficiently large grease filter, but care should be taken that the air crosses it without any preferential path.

In the filtration mode, the air path further includes an activated-carbon filter, which absorbs the smells derived from the cooking. This filter has to be easily accessible, so that the user can replace it once exhausted. The efficiency and the life of this filter are improved, if its volume and section crossed by the air are large.

After having passed through the above mentioned filters, the air is then sucked by a fan which is usually of the centrifugal type, inasmuch as axial fans do not have a sufficient head, and then conveyed in a conduit towards one of the possible outlets.

In the most common case, during the installation, a plug or predetermined fracture zones determine whether the air will exit the hood in the upward or the rear direction. The user, on the other hand, by maneuvering an appropriate deflection valve which has an easily accessible rod, can cause the air to exit by the front louvers of the hood.

A hood of good quality should therefore satisfy the following requisites: a sufficient air head in the suction mode; good capacity for reducing smells in the filtration mode, and therefore a large frontal surface of the activated carbon filter; reduced noise; reduced dimensions, for optimization of the available space; and last but not least, aesthetic features are very important, and require the design of hoods of minimal height. As a general practice, the activated-carbon filter is constituted by a single cartridge which is fixed to the nosepiece of the fan (as shown in FIG. 3). In this way the installation and replacement of the exhaust cartridge are very easy but, as already said, due to the need for making hoods that are very thin, the space which remains between the grease filter and the activated-carbon filter is very small and therefore this fact requires chokes around the edge of the activated-carbon cartridge.

Said fixing mode therefore makes the grease filter not very efficient, because a great part of the air is sucked exclusively in its central zone, near the nosepiece. An unpleasant grease spot is therefore rapidly created in the central zone on the external side which makes evident a non-uniform air distribution.

From the same FIG. 3 it is evident that, according to said solution, there is no reason for mounting carbon filters having very large dimensions, inasmuch as, considering the reduced available space, preferential paths will be created within them, in correspondence of the axis of the nosepiece, while the periphery of the cartridge will not be efficiently exploited. For this reason, limits on the height of the hood also determine limits for the extension of the cross section of the activated-carbon filter, and therefore, limits on the performance of the hood in relation to filtration efficiency and charge losses.

From FIG. 4, which shows a typical development of the conduits which extend downstream of the fan, it is evident that, always due to the reduced available space, the air in the front filtration mode, is compelled to follow a tortuous path, which causes great noise and charge losses, thereby limiting the air head which can be sucked. From the same figure, it is also evident that the same conduits do not leave space for mounting the activated-carbon filter downstream of the fan, and upstream of the valve for deflecting the air towards the upper or the front part of the hood.

In order to have reduced overall dimensions, some models of hoods are partially encased within the overhanging wall cabinet, with the further drawback that, besides higher costs, the differing dimensions of various furniture products have to be taken into account.

A further drawback is in the fact that, in order to pass from a filtration mode to a suction mode, the filter cartridge has to be removed from the hood and stored in another place.

OBJECTS OF THE INVENTION

The present invention has the aim of resolving the above mentioned drawbacks. In this light, a first aim of the invention is that of allowing reduction of the height of the hood or, more generally, of allowing reduction of the dimensions of the hood in the direction parallel to the fan axis, thereby even improving the degree of uniform air flow through the grease filter.

A second aim of the present invention is that of showing how it is possible to install activated-carbon filters larger than usual ones, and whose dimensions are limited only by the plan dimensions of the hood itself and not by its thickness, so as to improve filtration efficiency.

Another aim of the present invention is that of providing a hood which, in the most general case, allows for change among the four operating modes without the necessity of a flow deflection valve or closure plugs for the outlets not being used.

These and further aims are attained according to the present invention by a hood for the suction and/or the filtration of cooking fumes in a domestic kitchen having the features of the annexed claims.

BRIEF DESCRIPTION OF THE DRAWINGS

Further characteristics and advantages of the present invention will be clear from an illustration of the hoods according to the prior art and from the description of some preferred, but not exclusive, embodiments of the hood according to the invention, which are shown as a pure example in the following figures (wherein the parts which do not pertain to the invention have been omitted)

FIG. 2 shows in a schematic way the air flow from the drawing zone towards one of the three possible outlets. FIG. 3 shows with a side cross section the activated-carbon filter fixed to the nosepiece of the fan and the effects of this assembly on the flow of the sucked air. FIG. 4 shows, with a horizontal cross section, how the air conduits from the fan scroll to the three possible outlets are realized in the known hoods;

DETAILED DESCRIPTION OF THE INVENTION

Figure 1:
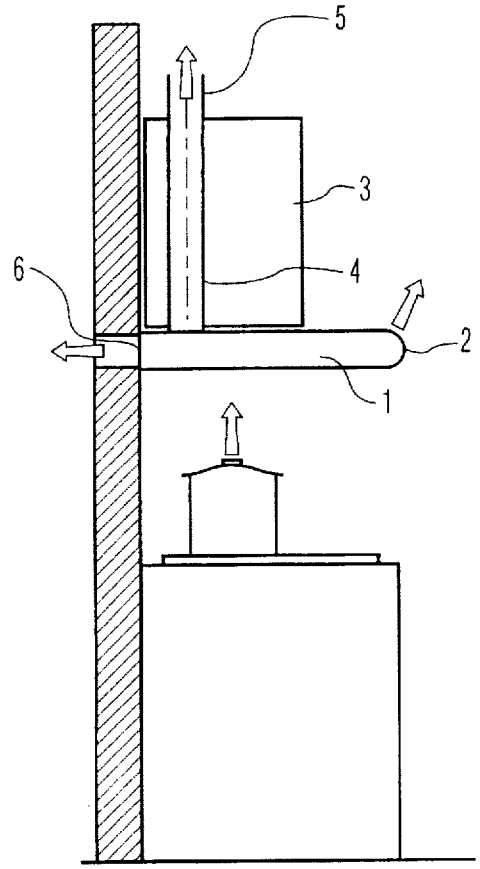
FIG. 1 PRIOR ART
FIG. 1 is a side view of a hood, as it is normally installed above a cooking stove, which shows the air exit zones in the different operating modes, i.e., filtration or suction.

With reference to FIG. 1, the installation of a hood 1 is usually carried out by fixing it underneath a wall cabinet 3. The air sucked from a cooking stove, when filtered, may be recycled in the room through louvers present on the front part 2 of the hood 1, or through a tube 4 hidden by said wall cabinet 3. Alternatively, when the sucked air is expelled, this can occur by means of said tube 4, which is connected to a further conduit 5 directed outside of the room, or directly through a hole 6 being present in the rear part of the hood 1.

Figure 2:
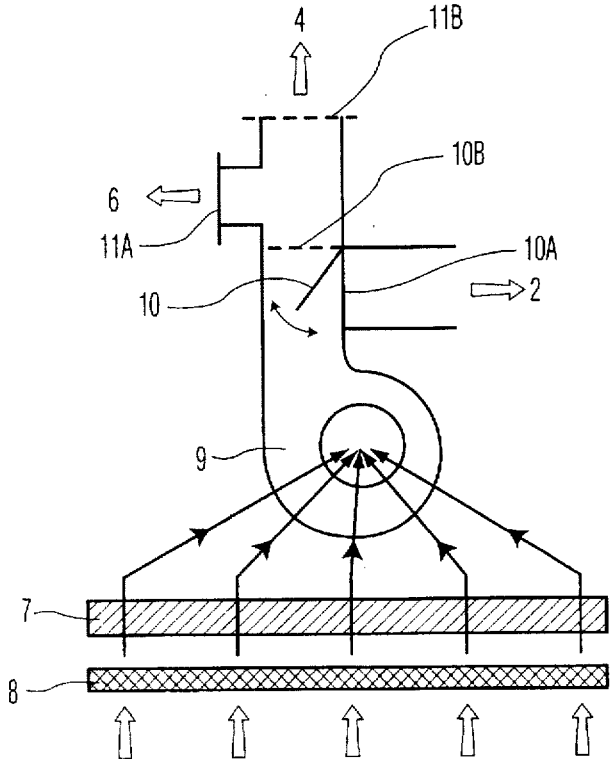
FIG. 2 PRIOR ART
FIGS. 2 to 4 show how the filter means and the air conduits are arranged in a hood according to the prior art. In particular.

With reference to FIG. 2, the air flow, following the direction of the arrows, crosses a grease filter 7, and then, according to prior art, an activated-carbon filter 8 (when present), a suction fan and the relative scroll 9. A valve 10, when in position 10A, provides for deflecting the flow in the direction of the front part 2, while in position 10B directs the flow in the direction of one of the two exits, the upper one 4 or the rear one 6, a plug 11, or other suitable closure means, established at installation, if the hood must have an upper exit 4 or a rear exit 6. In the latter case, the plug is mounted in the position 11B.

Figure 3:
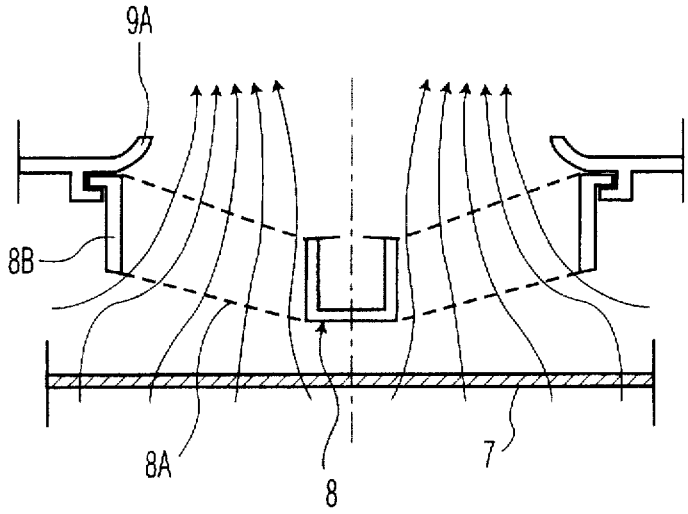
FIG. 3 PRIOR ART

In FIG. 3 the grease filter 7 and the activated-carbon filter 8 are shown, according to another pertinent solution of the prior art, the filter 8 having a lower surface 8A permeable to the air and a side wall 8B of a compact material. The filter 8 is mounted on the nosepiece 9A of the fan, not shown in the figure, and is removed in the suction mode.

Figure 4:
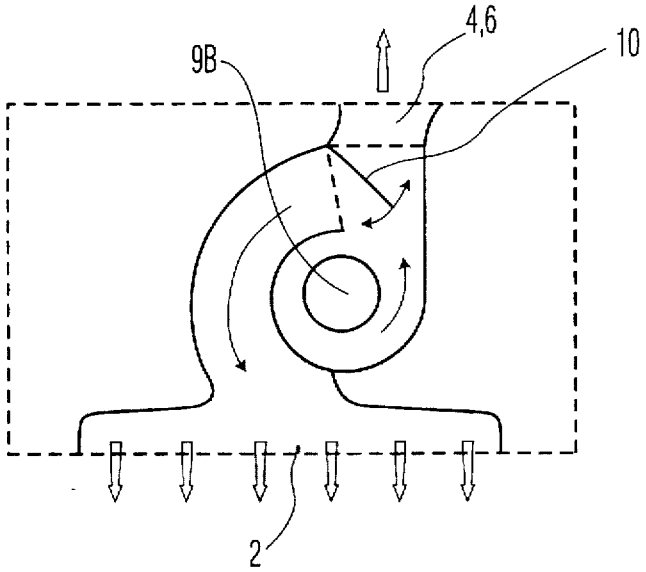
FIG. 4 PRIOR ART

In FIG. 4, there are shown, arranged according to the prior art, a fan 9B, the deflection valve 10, the upper exit 4 or the rear exit 6, the front exit 2.

Figure 5A:
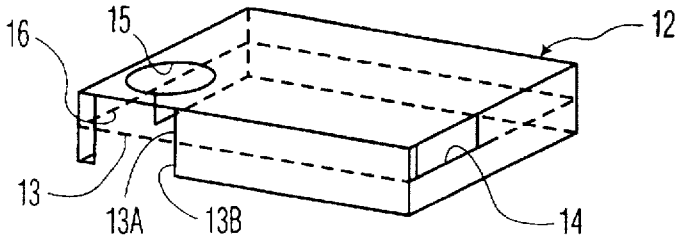
FIGS. 5A–F show, with an exploded axonometric schematic view, in accordance with one of the preferred embodiments of the invention which does not require any additional flow deflection means, the four operating mode of the hood which are possible in accordance with the invention.
Figure 5B:
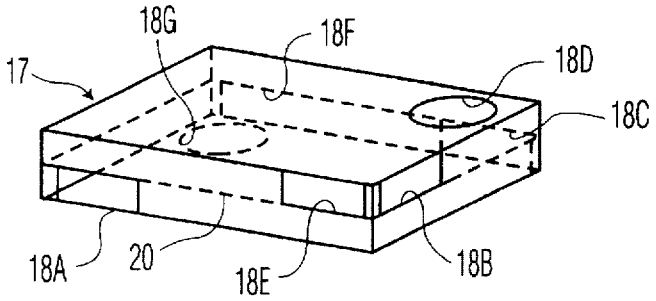

In FIGS. 5A–F an envelope 12 is shown according to a first possible embodiment of the invention, which has an air inlet 13 connected to the discharge of the fan, not shown in the figure. The inlet 13 is subdivided into two zones, an upper one 13A and a lower 13B one, being separated in the figure by a dotted line. The figure shows furthermore outlets 14, 15, 16, for the connection, respectively, with the front exit 2, the upper exit 4 and the rear exit 6 of FIG. 1. Under the envelope 12 a hollow means, or container 17, is shown, according to a first embodiment of the invention, in the following four possible advantageous positions:

FIG. 5B indicates the position in which said container 17 is arranged in the installation provided for the front filtration operating mode (FA)

Figure 5C:
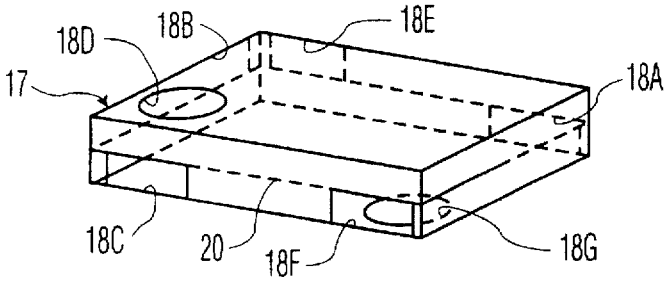

FIG. 5C indicates the position in which said container 17 is arranged in the installation provided for the upper filtration operating mode (FS). The position shown in FIG. 5C is obtained from the previous one FIG. 5B, by rotating the container 17 of 180° around the vertical axis.

Figure 5D:
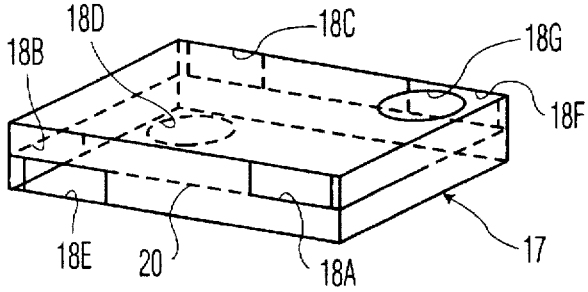

FIG. 5D indicates the position in which said container 17 is arranged in the installation provided for the rear suction operating mode (AP). The position FIG. 5D is obtained from the previous one (FIG. 5C, by overturning the container 17.

Figure 5E:
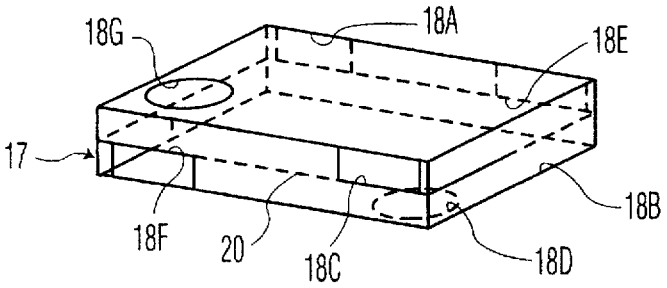
Figure 5F:
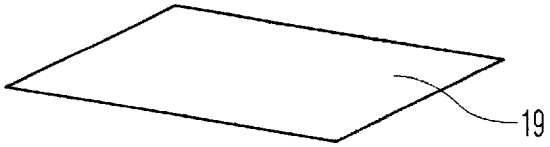

FIG. 5E indicates the position in which said container 17 is arranged in the installation provided for the upper suction operating mode (FA). The position shown in FIG. 5E is obtained from the previous one FIG. 5D, by rotating the container 17 of 180° around the vertical axis.

References 18A, 18B, 18C, 18D, 18E, 18F, 18G indicate different openings provided in the container 17. A lower cover 19 or other closure means is used for closing the container 17 according to one of the positions FIGS. 5B–E within the envelope or seat 12. The hatched zone 20 indicates a medium zone, wherein air treatment means are located, when being present inside the container 17. The treatment means are not represented in the figure, for clarity purposes.

In FIG. 6, with 12 the same envelope of FIGS. 5A–F is indicated. Reference numerals FIGS. 6B–E indicate four different positions for a single air flow deflection means 17', wherein the suffixes from "A" to "D" indicate the same position already shown in FIGS. 5A–F, references 18A', 18C', 18F' indicate openings having the same function of the corresponding openings 18A, 18C, 18F of FIGS. 5B–E. In FIGS. 6B–E there is a single opening 18BE' corresponding to the two openings 18B and 18E in FIGS. 5B–E. The hatched zone 20 indicates the position for the air treatment means being eventually present, similarly to FIGS. 5A–F. The lower closure means is indicated by reference numeral 19. The hollow means 17' has the same function as the container 17 of FIGS. 5B–E, but in the case shown in FIGS. 6A–F, it is formed by a sort of frame, which has walls only where necessary for functional or structural reasons.

Figure 7:
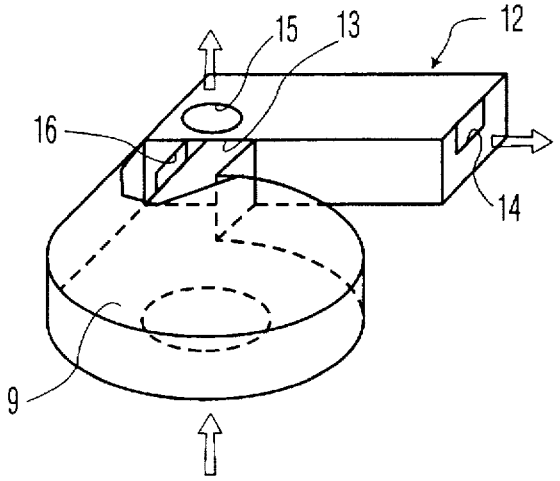
FIG. 7 shows, with an axonometric view, the assembly of the ventilation group and a flow deflection filter according to the embodiment of the invention shown in FIGS. 5A–F.
Figure 8:
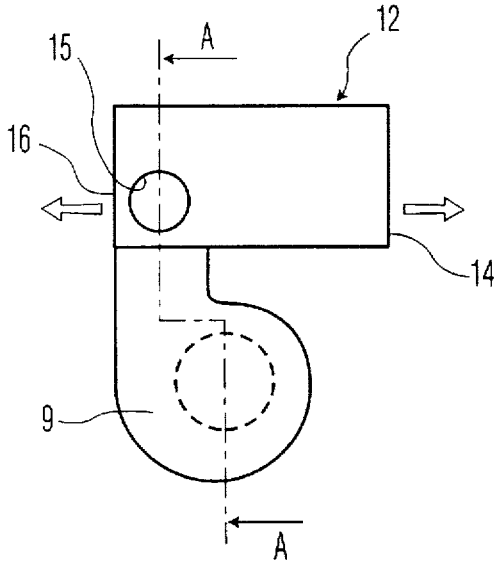
FIG. 8 shows, with a plan view, the assembly of the ventilation group and a flow deflection filter according to the embodiment of the invention shown in FIGS. 5A–F.

In FIGS. 7 and 8, the openings in the envelope 12 are indicated, with the same reference numbers as in FIG. 5A. Therefore, 13 is the inlet for the air coming from the scroll 9, while 14, 15, 16 indicate respectively the front exit, the upper exit and the rear exit.

Figure 9:
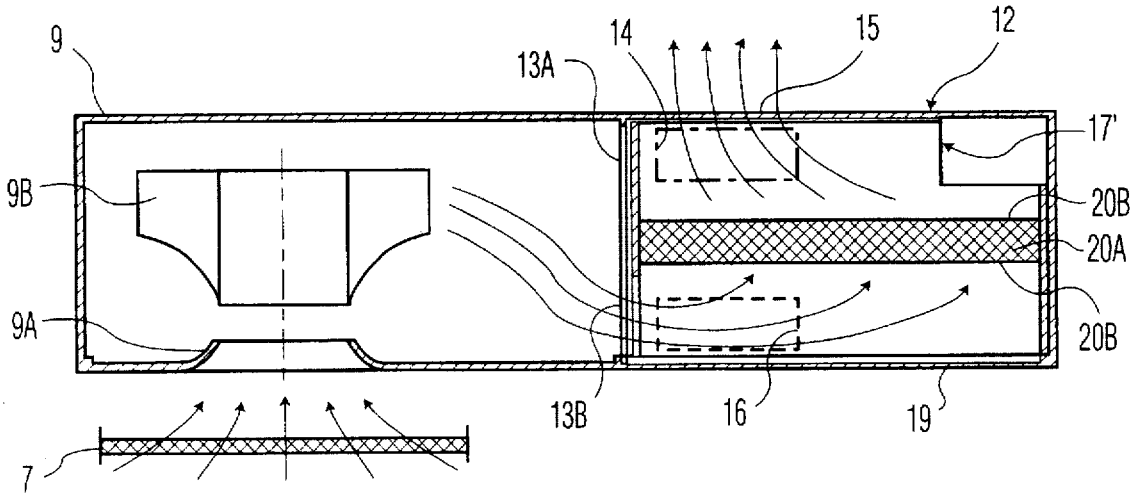
FIG. 9 shows, for clarity purposes, a section of FIG. 8 according to line A—A.

FIG. 9 shows in section the grease filter 7, the nosepiece 9A, the fan 9B, the scroll 9, the opening 13A–13B, the envelope 12 with the relevant openings 14, 15 and 16. The deflection means 17' is in the position shown in FIG. 6B, corresponding to the upper filtration mode (FS). There are a lower closure means 19 and a zone 20A delimited by air permeable walls 20B, which contains the air treatment means, such as an activated-carbon filter.

Figure 10:
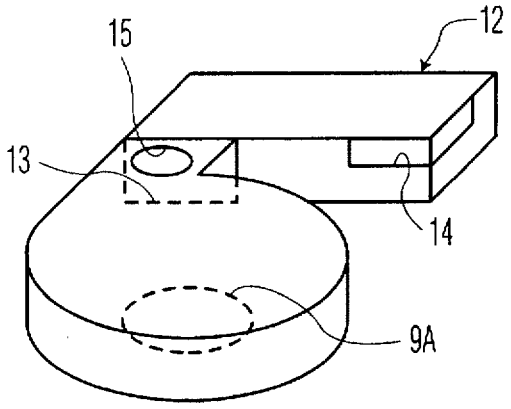
FIG. 10 shows, with an axonometric view, the assembly of the ventilation group and a flow deflection filter according to a different possible embodiment of the invention.
Figure 11:
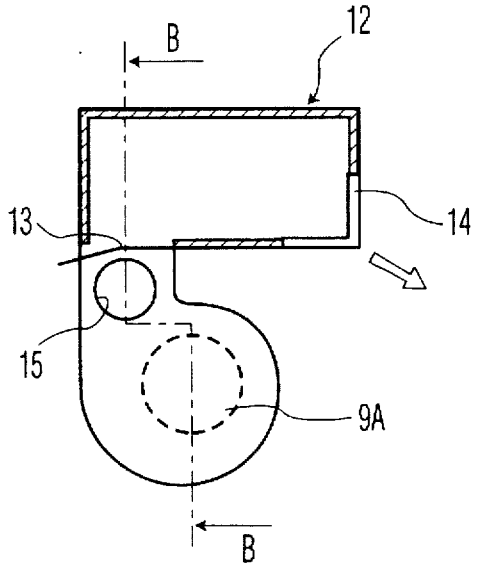
FIG. 11 shows, with a plan view, the assembly of the ventilation group and a flow deflection filter according to the embodiment of the invention shown in FIG. 10.

FIGS. 10 and 11 refer to an embodiment of the invention, which differs from that of FIGS. 5 to 9. However, for clarity reasons, similar components are indicated with the same numbers already utilized in the previous Figures. Thus, an envelope 12 is shown, having an opening 14 in the direction of the front part, a scroll with an inlet nosepiece 9A and finally two air outlets, i.e. one, indicated with 13, towards the envelope 12, and the other indicated with 15, towards the upper discharge of the hood.

Figure 12A:
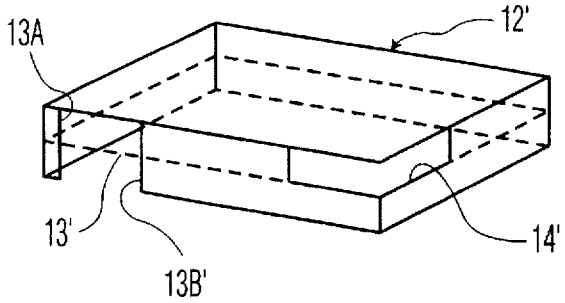
FIGS. 12A–D show, with an exploded axonometric and schematic view and in accordance with the embodiment of FIG. 10, the flow deflection filter with the container according to the invention arranged in the two advantageous position for said embodiment.
Figure 12B:
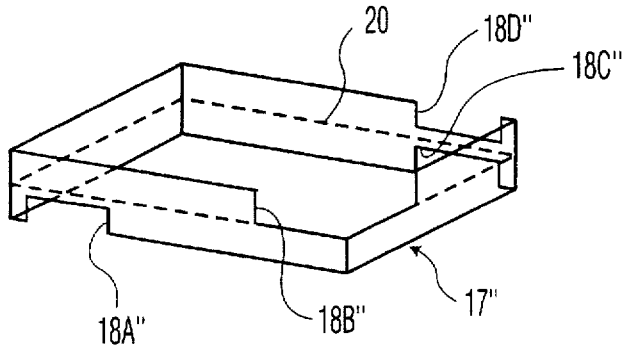

In FIGS. 12A–B there is shown, in accordance with a second possible embodiment of the invention an envelope 12' having an air inlet opening 13', being divided into the two zones 13A' and 13B', and connected to the discharge of the fan, not shown in the Figure. Furthermore, there are shown the outlet 14' towards the front discharge 2 of FIG. 1. Under the envelope 12 a flow deflection means 17" is indicated, in the position shown in FIG. 12B provided for the front filtration operating mode (FA). In 17B, the container 17" is shown in the position being provided for the upper filtration operating mode (FS) . References 18A", 18B", 18C", 18D" show different openings provided in said container, even if they do not necessarily correspond to those shown in FIGS. 5 and 6. The cover 19 of a lower closure means is provided for closing the container 17" according to one of the positions shown in FIGS. 12B or 12C within the envelope 12. The hatched part 20 indicates a zone being delimited by air permeable walls, which contains the air treatment means, such as the cited activated-carbon filter, being eventually present within the container 17".

In FIGS. 12E–H a device is shown, functionally similar to that of FIGS. 12A–D, but having a substantially cylindrical shape, where the homologous parts have been indicated with the same reference numbers utilized in FIGS. 12A–D. It is evident that, in the same way, a cylindrical device derived from FIGS. 5A–F could be obtained.

Figure 12C:
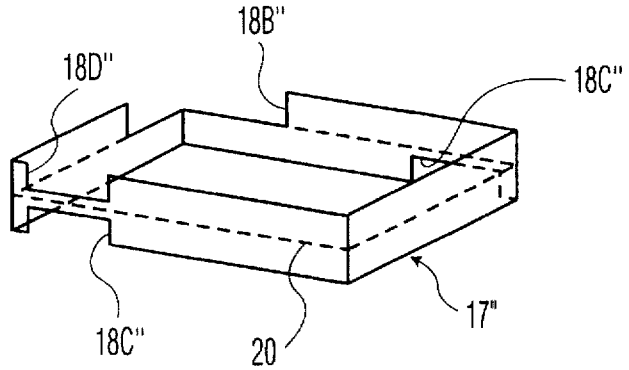
Figure 12D:
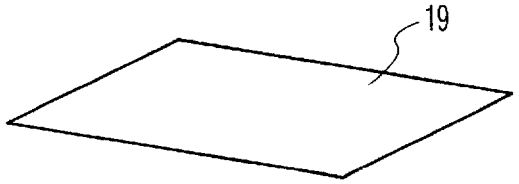
Figure 12E:
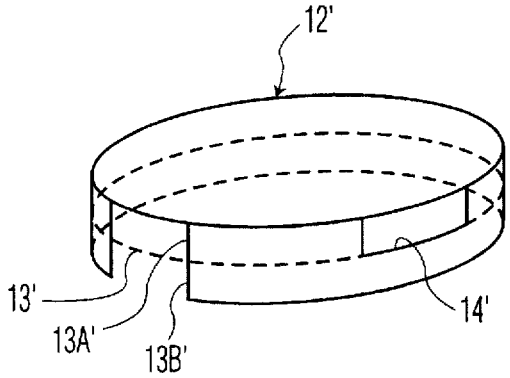
FIGS. 12E–H show, with an exploded axonometric and schematic view, the flow deflection filter with the container according to the invention and in accordance with FIGS. 12E–H, but having a cylindrical shape instead of a parallelepiped one.
Figure 12F:
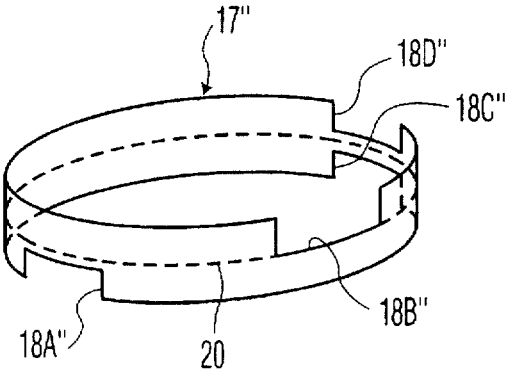
Figure 12G:
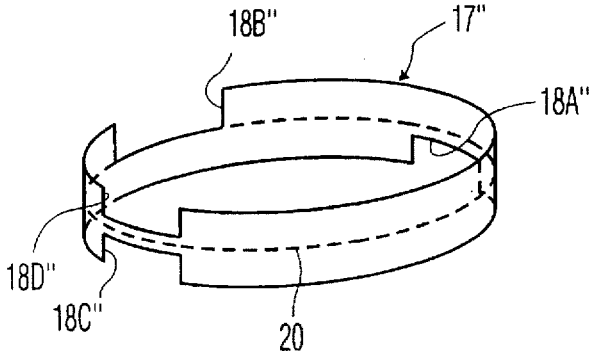
Figure 12H:
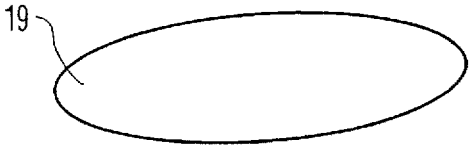
Figure 12J:
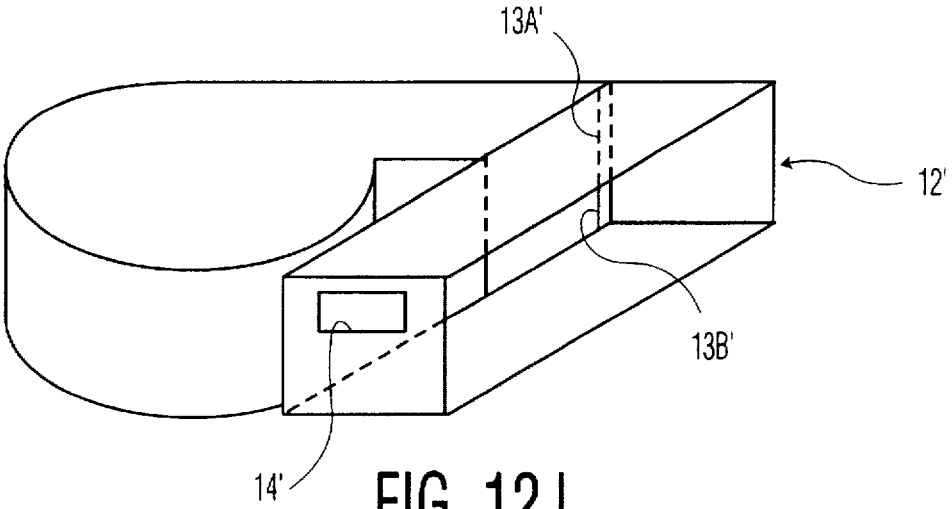
FIGS. 12J–L show, with an exploded axonometric and schematic view, the flow deflection filter according to an embodiment different from the preceding ones, which allows for the same operating modes already shown in FIGS. 12A–D.
Figure 12K:
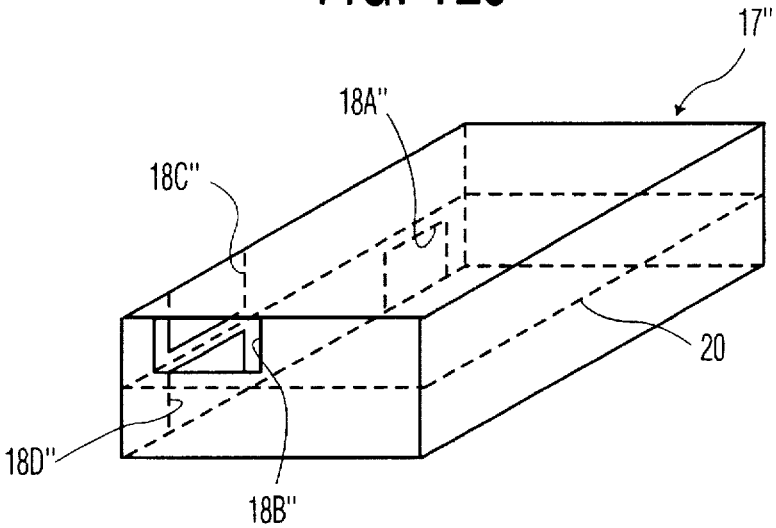
Figure 12L:
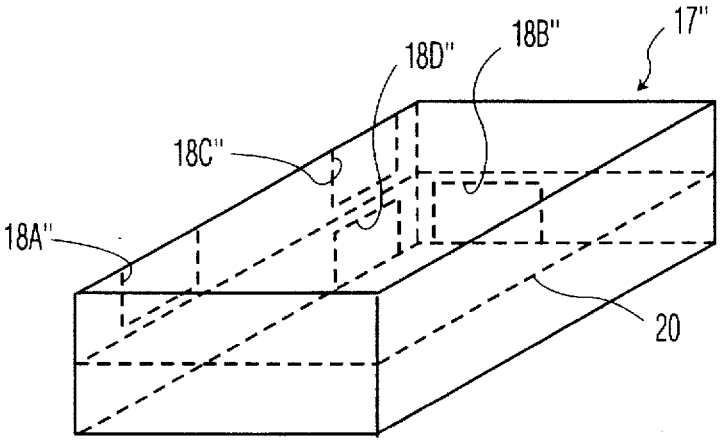

In FIG. 12J–L a further embodiment of the deflection device of the hood according to invention is shown. The homologous parts have been indicated with the same reference numbers utilized in FIG. 12.

Figure 13A:
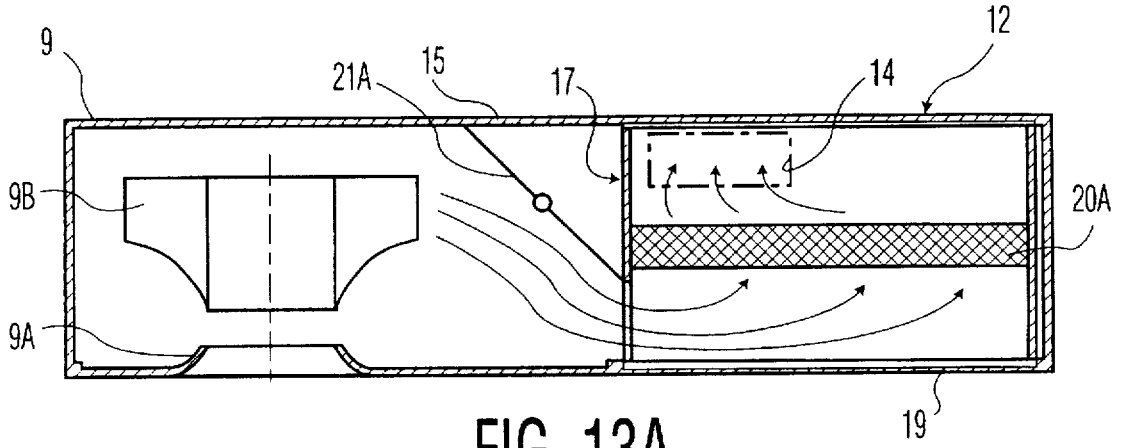
FIGS. 13A–C show three cross sections of FIG. 11 according to line B—B, for indicating the air path respectively in the Front Filtration mode, the Upper Filtration mode and the Upper Suction mode.
Figure 13B:
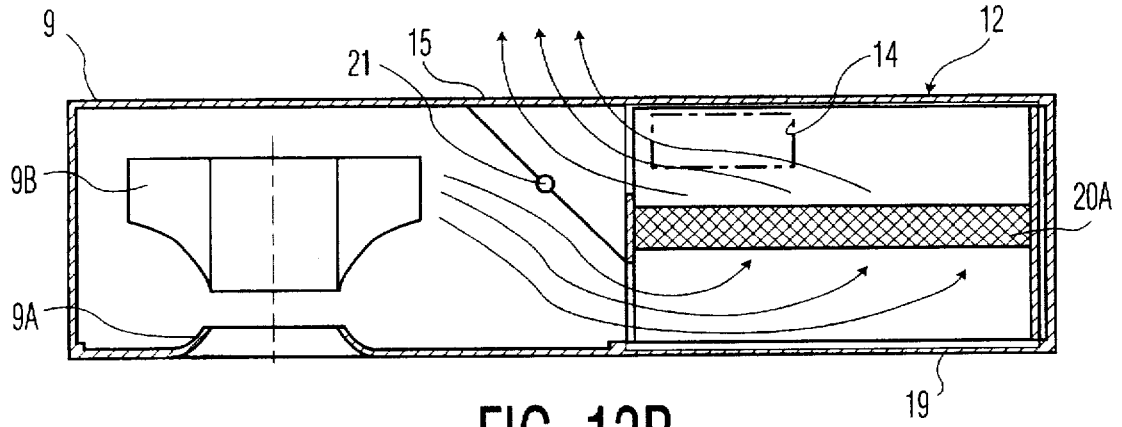
Figure 13C:
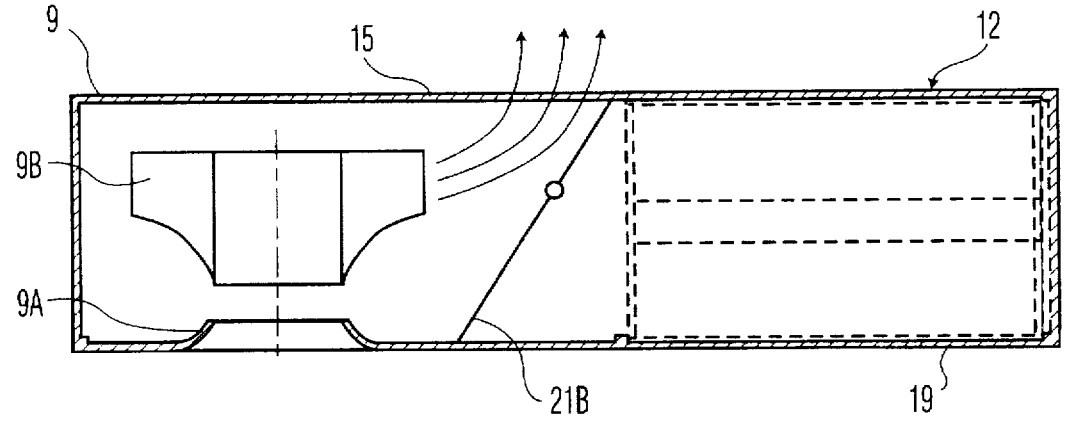

In FIGS. 13A–C there are shown the inlet nosepiece 9A of the scroll 9, the fan 9B, a deflection throttle-valve 21 for the air flow, in the possible positions 21A and 21B, the container 17 having, in an intermediate position, an air permeable means to the air (such as the cited activated-carbon filter 20A), the opening 14 towards the front exit 2 of FIG. 1, the outlet 15 in the direction of the upper part, and the closure means 19 of the envelope 12.

Figure 14:
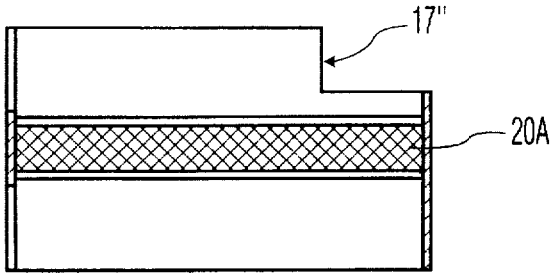
FIG. 14 shows, with a vertical cross section, one of the possible embodiments of the container according to the invention.
Figure 15:
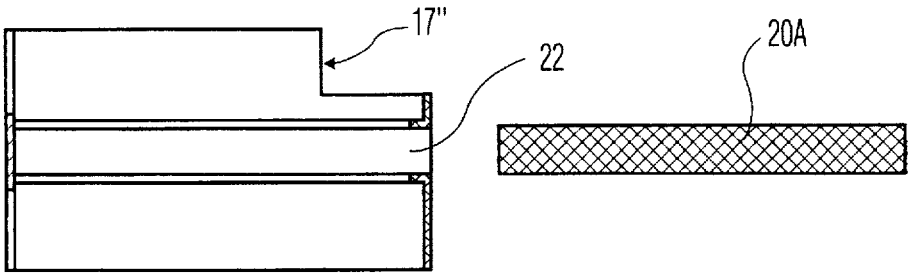
FIG. 15 shows, with a vertical cross section, a further possible embodiment of the container according to the invention.

In FIG. 14 the container 17" is shown in section according to the position shown in FIG. 12C, and an incorporated air treatment means 20. In FIG. 15 the container 17" is shown in section, according to the position shown in FIG. 12C, with a housing seat 22 and the air treatment means 20A being evidenced.

Figure 16A:
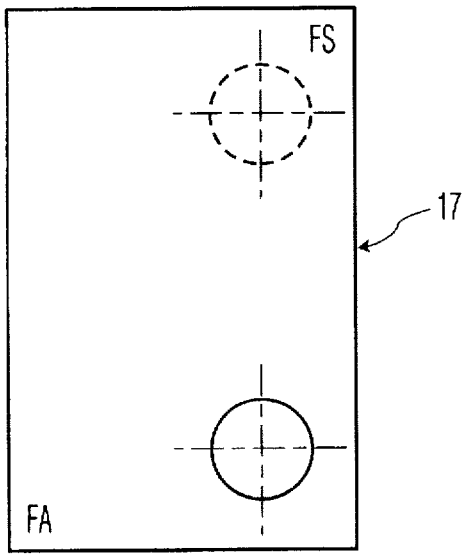
FIGS. 16A and B show graphic symbols stamped on the two main surfaces of the container in accordance with the embodiment of the invention shown in FIGS. 5A–F.
Figure 16B:
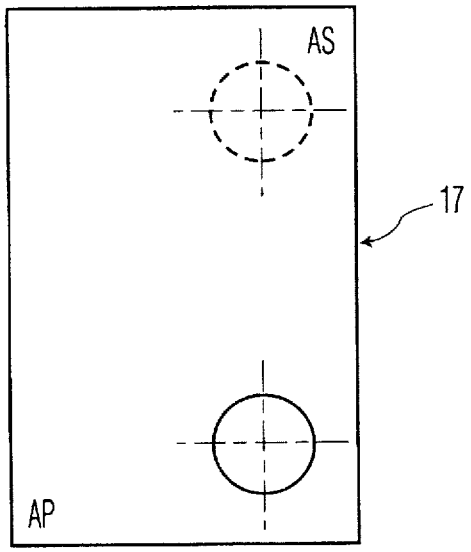

In FIGS. 16A and B the container 17 is shown in accordance with FIGS. 5A and B, respectively, which has graphic symbols FA, FS, AS and AP. The container 17 is represented in plan, according to the positions shown in FIGS. 5B and 5C.

It is clear that, though not represented, many other embodiments are possible for the system without departing from the inventive idea, some of which will be briefly cited in the following description of the function.

The function and the advantages of the flow deflection filter according to invention will be now described.

With reference to FIGS. 7 and 8, the air sucked by the fan is introduced through the scroll 9 in the envelope 12. If the envelope 12, instead of providing for deflection means, would be closed downwards by the cover 19 of FIG. 5F, the air could simultaneously exit by the outlets 14, 15 and 16. On the contrary, with reference to FIG. 5, if the container 17 is arranged within the envelope 12 in any position and said envelope 12 is closed with the cover 19, it is clear that said container 17 partially obstructs the inlet 13 (part 13A or part 13B), and two of the three outlets 14, 15 and 16. In fact, said container 17 has a size which enables entry into the envelope 12 with good precision so that air can pass only through the free openings, without any substantial undesired leak through skylights and fissures. If the container 17 is inserted in the position shown in FIG. 5B, corresponding to the cited front filtration operating mode (FA), the air can enter the envelope 12 only through the zone 13B of the inlet 13, which is left free by the opening 18A of the container 17, and can exit only in the direction of the front part 2 of FIG. 1 through the outlet 14, which is left free by the opening 18B, and only after having crossed the middle plane 20 of said container 17, while the outlets 15 and 16 are closed by the walls of the same container 17.

Similarly with the container 17 being rotated by 180° in the position shown in FIG. 5C, i.e, for the so-called upper filtration mode (FS), the air enters by the openings 13A and 18C, crosses the middle plane 20 and then exits by the outlet 15, which is left free by the opening 18D, towards the upper discharge 4 of FIG. 1. By overturning the container 17 in the position 17C, which corresponds to the rear suction operating mode (AP), the air enters the envelope 12 and the container 17 through the facing openings 13B and 18E, and therefore the air, without crossing the meddle plane storey 20, exits by the openings 18B and 16 in the direction of the rear part 6 of FIG. 1.

Finally, by again rotating the envelope by 180°, the position shown in FIG. 5E is obtained, which corresponds to the upper suction operating mode (AS), in which the air enters the envelope 12 through the zone 13A of the inlet 13, which is left free by the opening 18F of the container 17. The air therefore exits by the openings 18G and 15 towards the upper discharge 4 of FIG. 1, in the same way as for the position shown in FIG. 5C, but now the air cannot cross the middle plane 20.

It is evident that the closure means 19 and the envelope 12 that houses the container 17, could be coupled to any surface, even one that is not flat, rather than on the lower face as shown in FIGS. 5A–F. For example, the cover 19 could close on a lateral face and the container 17 would be inserted in the envelope 12 in the way of a drawer. Alternatively the cover 19 may not be necessary, and can be replaced by a continuous face, without any openings, of the container 17. This would be possible, for example, when only the operating mode allowed by the positions shown in FIGS. 5B and C are provided. In this case, therefore, the opening 18G would not be necessary.

It is furthermore evident that the envelope 12, which substantially delimits a variety of surfaces housing the container 17, might be not expressly realized:, it might be totally or partially obtained by the surfaces of the surrounding bodies and means, such as for example the horizontal and vertical walls of the hood.

It is also evident that the container 17 need not necessarily have the box shape of FIGS. 5B–E but, as illustrated in FIGS. 6A–F, it could be simply composed by a sort of frame 17', having walls only where these are necessary for providing an obstacle to the air flow, or for ensuring structural sturdiness, or for supporting air treatment means eventually and advantageously contained in it.

Figure 6A:
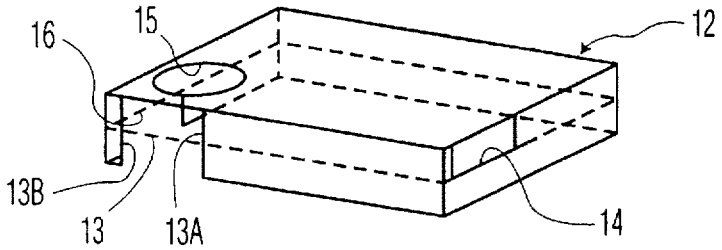
FIGS. 6A–F show, with an exploded axonometric and schematic view, substantially similar to that of FIGS. 5A–F a container being of simplified construction, where the material constituting its external surface is present only in the essential points for structural reasons and for attaining the aim of the invention.
Figure 6B:
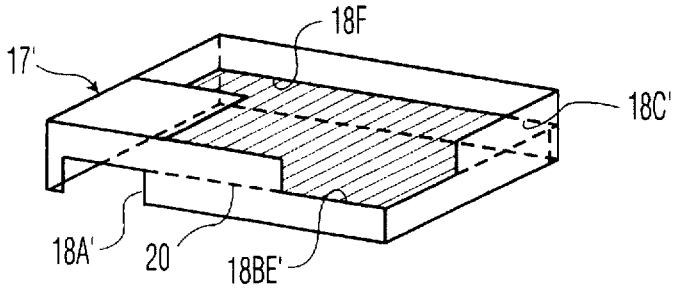
Figure 6C:
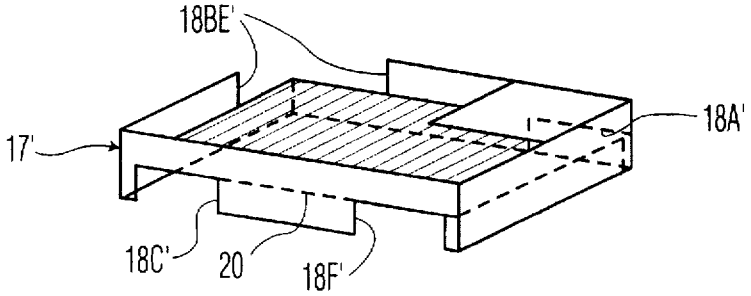
Figure 6D:
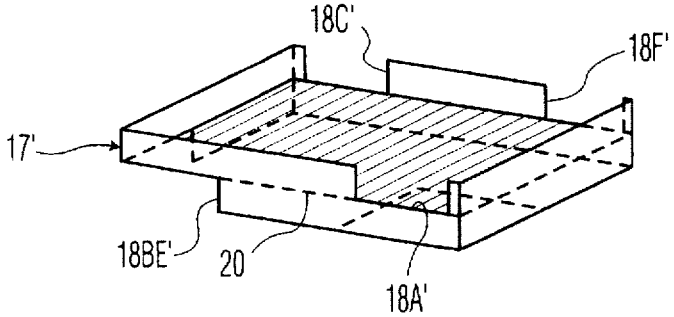
Figure 6E:
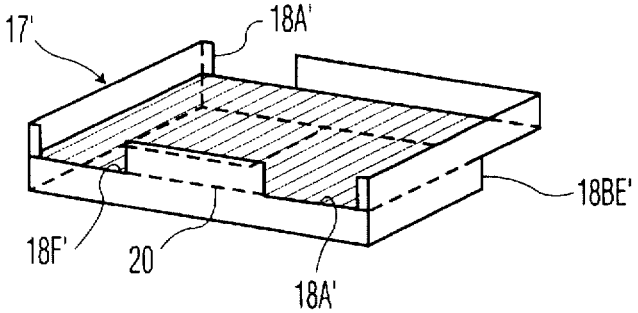
Figure 6F:
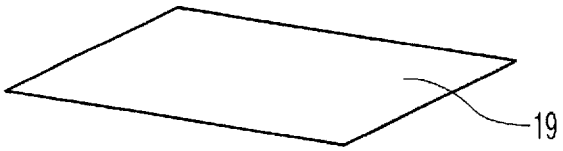

For a greater understanding of the function, FIG. 9 illustrates the same case of FIGS. 6A–F with the means or container 17' in the position shown in FIG. 6C.

The air enters the envelope 12 by the opening 13B underlying the air permeable means 20A and disposed in the middle plane of the container 17'. Due to the fact that the outlets 14 and 16 are closed by the container 17', the air is obliged to exit only by the outlet 15, after having crossed the means 20A, that could be advantageously constituted by an activated-carbon filter or other air treatment means.

In FIGS. 10, 11, 12A–D and 13A–C a preferred embodiment of the invention is shown, for the case in which the available space in width for the hood is not sufficient to provide the outlet 15, for coupling with the upper exit conduit in the direction of channel 4 of FIG. 1, directly on the envelope 12 and, as it happens in most cases, the rear exit is not provided. In fact, if the space in width is not sufficient, said opening 15 has to be realized in correspondence with the exit of the scroll 9. In that case, for the deflection of the air flow the auxiliary deflection means 21 of FIGS. 13A–C is used. For obtaining the upper suction mode (AS), the deflection means 21 has to be set in the position 21B of FIG. 13C, while the position of the container 17 is not relevant, it being excluded from the air circuit. On the other hand for obtaining the filtration mode, the deflection means 21 has to be set in the position 21A of FIG. 13A, so that the air can enter the envelope 12 and must pass through the means 20A In that case, the upper filtration mode (FS) is obtained, if the container 17 is arranged in the position shown in FIG. 12C, while the front filtration mode (FA) is obtained when the container 17 is arranged in the position shown in FIG. 12B. In order to illustrate the versatility of the invention, FIGS. 12A–D shows the same device already illustrated in FIGS. 12A–D, with the difference that now it has a substantially cylindrical shape. It is evident that a rotation of 180° of the device modifies the function exactly as in FIGS. 12A–D, with the advantage that the rotation of an element being of cylindrical shape can be realized by means of a suitable command means provided by the hood, for example a sprints knob, having a suitable mechanism, for changing the position of the cylindrical container 12' without any intervention within the hood.

FIGS. 12J–L shows instead how the same functioning way of FIGS. 10, 11, 12 and 13 could be obtained, according to another embodiment of the flow deflection device according to the invention, not by rotating the container 17", but overturning it. It can be furthermore noticed that, in the illustrated embodiment of FIGS. 12J–L, the cover 19 is not necessary.

FIG. 14 shows how, in a preferred embodiment, the container 17" can be constituted by a cartridge, containing an activated-carbon filter 20A, having walls formed for example as in FIGS. 12B and C. Such a cartridge 17" is drawn and replaced when the activated-carbon has lost its filtration efficacy. In FIG. 15, instead, the container 17", at the middle axis, has a hollow 22 wherein the activated-carbon filter 20A or any other air treatment means that has to be withdrawn once exhausted, is inserted.

Apparently, it can seem complicated to entrust the user with the task of orienting the container 17 or 17", or the frame 17', in the correct way. However, on the contrary, from FIGS. 16A and b, to this purpose it is sufficient to mark the end of the relevant faces with suitable duly oriented symbols. For example said container 17 is shown according to the positions shown in FIGS. 5B and 5D, and the symbols FA, FS, AP, AS, have been used, which are the initials, in the Italian language, of the previously described operating mode (front filtering, upper filtering, rear suction, upper suction).

It is evident from the given description how the present invention introduces important improvements in the functioning of hoods.

According to the invention, it is in fact possible to eliminate the activated-carbon filter from the scroll inlet, thereby freeing some space for uniform circulation of the air between the grease filter and the nosepiece of the fan, and also reducing the height of the hood. The arrangement of the filtering means downstream of the scroll, according to the present teachings, does not require additional space, but instead it better utilizes the existing one. It simplifies the conduits downstream of the scroll and finally allows the use of filters having an effective passage section, of the desired dimensions, being limited only by the external dimensions of the hood. On the contrary, it has been seen that in a filter, even being very wide, mounted on the nosepiece, the zone effectively crossed by the air is limited to the area of the nosepiece.

The described invention is susceptible of several modifications and variations, which fall within the inventive idea. It is clear that all the described details and constructive materials can be changed with others which are technically equivalent. The practical examples herein illustrated are only some of the possible ones.

I claim:

1. Suction and/or filtration hood, having a flow deflection device comprising an outer envelope having one or more inlets and one or more outlets, and a hollow means having a plurality of apertures in communication with a chamber defined therein through which air can pass said hollow means being mountable within said outer envelope in a plurality of positions whereat only one inlet of the envelope is in alignment with one aperture of the hollow means and only one outlet of the envelope is in alignment with another aperture of the hollow means, said envelope obstructing all apertures of said hollow means other than said one aperture and said another aperture, and said hollow means obstructing all inlets and outlets of said envelope other than said one inlet and said one outlet, whereby air can flow through said chamber only between said one inlet and said one outlet.

2. Hood, according to claim 1, wherein at each of said positions, said one aperture and/or said another aperture is out of alignment with the inlet or outlet with which it is aligned at another of said positions.

3. Hood, according to claim 1, wherein said hollow means comprises an internal plane where air treatment means are arranged, the air being compelled or impeded to pass through said internal plane depending upon the position chosen for said hollow means within said envelope.

4. Hood, according to claim 1, wherein said envelope and said hollow means are respectively constituted by box-like bodies having an external surface being substantially parallelepiped shaped.

5. Hood, according to claim 1, wherein said envelope and said hollow means have a substantially cylindrical shape.

6. Hood, according to claim 1, wherein two of the inlets of said envelope merge into a single opening, each of the two inlets being selectable by changing the position of the hollow means inside the envelope.

7. Hood according to claim 1, further comprising an external cover, said envelope sharing at least one wall with said external cover.

8. Hood, according to claim 1, wherein said hollow means comprises a frame having walls only in the regions that cover the inlets and outlets of the envelope.

9. Hood, according claim 1, wherein said envelope further comprises closure means having a substantially flat surface for enclosing said hollow means within the envelope.

10. Hood, according to claim 1, further comprising flow deflection means mounted upstream of the envelope and the hollow means, said flow deflection means being movable between one position for directing air through the hollow means and another position for directing air around the hollow means.

11. Hood, according to claim 1, wherein said hollow means contains means for air treatment.

12. Hood, according to claim 11, wherein in one of said positions of said hollow means said air treatment means is in the path of air flow and in another of said positions of said hollow means said air treatment means is out of the path of air flow.

13. Hood, according to claim 11, wherein said air treatment means comprises an air permeable wall containing a substance for filtering, purifying and/or disinfecting the air.

14. Hood, according to claim 13, wherein said air permeable wall is disposed in a plane inside of the hollow means.

15. Hood, according to claim 13 wherein the air treatment means is removably mounted in the hollow means for replacement when the substance is exhausted.

16. Hood, according to claim 1, wherein the hollow means has indicia on it for indicating the position in which it is mounted in the envelope.

17. Hood, according to claim 1, wherein the hollow means comprises a seat and a filter removably mounted on said seat.

* * * * *

UNITED STATES PATENT AND TRADEMARK OFFICE

CERTIFICATE OF CORRECTION

PATENT NO : 5,738,083

DATED : April 14, 1998

INVENTOR(S) : Pettinari

It is certified that error appears in the above-identified patent and that said Letters Patent is hereby corrected as shown below:

On the title page, sixth line, change "Turboaire" to --Turboair--;

eighth line, after [22] Filed: "Jan. 11, 1996"

insert

--[30] Foreign Application Priority Data

Jan. 12, 1995 [IT] Italy.....TO95A000013--

Signed and Sealed this

Twenty-eighth Day of July, 1998

Attest:

Attesting Officer

BRUCE LEHMAN

Commissioner of Patents and Trademarks